US005441162A

United States Patent [19]

Niblock

[11] Patent Number: 5,441,162

[45] Date of Patent: Aug. 15, 1995

[54] WIRE SHELF CORNER SUPPORT SYSTEM

[76] Inventor: George W. Niblock, 1059 Upper State Rd., Chalfont, Pa. 18914

[21] Appl. No.: 169,352

[22] Filed: Dec. 20, 1993

[51] Int. Cl.[6] ..... A47F 5/00

[52] U.S. Cl. ..... 211/153; 211/187; 248/243; 108/144

[58] Field of Search ..... 211/153, 187, 186, 181; 248/243; 108/107, 144

[56] References Cited

U.S. PATENT DOCUMENTS

| | | | |
|---|---|---|---|
| 1,952,111 | 3/1934 | Bales | 108/107 |
| 1,996,518 | 4/1935 | Levene et al. | 108/107 |
| 2,710,735 | 6/1955 | Stollenwerk | 248/243 X |
| 2,733,037 | 1/1956 | Dunham | 248/243 X |
| 2,825,470 | 3/1958 | Dahlin | 211/187 X |
| 2,850,172 | 9/1958 | Beckner . | |
| 2,919,816 | 1/1960 | Maslow . | |
| 2,939,589 | 6/1960 | Handler et al. | 108/144 |
| 2,990,067 | 6/1961 | Bartlett | 248/243 X |
| 3,104,626 | 9/1963 | Brunette . | |
| 3,146,734 | 6/1964 | Kesilman et al. . | |
| 3,208,408 | 9/1965 | Maslow . | |
| 3,294,250 | 12/1966 | Evans | 108/144 X |
| 3,424,111 | 1/1969 | Maslow . | |
| 3,523,508 | 8/1970 | Maslow . | |
| 3,675,598 | 7/1972 | Kesilman et al. . | |
| 4,158,998 | 6/1979 | Clement | 248/243 X |
| 4,318,352 | 3/1982 | Friedman et al. . | |
| 4,558,647 | 12/1985 | Petersen . | |
| 4,750,626 | 6/1988 | Nicely . | |

*Primary Examiner*—Robert W. Gibson, Jr.
*Attorney, Agent, or Firm*—John W. Logan, Jr.

[57] ABSTRACT

An adjustable wire shelf structure is provided wherein each shelf has an open wire mesh surface and vertical side walls terminating short of the corners of the shelf. A shelf corner mount member is secured to each corner of the shelf to provide mounting means to attach to conventional shelf support posts. The corner mount members have two legs at right angles to one another with each leg having a first portion terminating adjacent the ends of its abutting side wall and a second portion inwardly offset from the first portion a distance approximately equal to the thickness of the side wall with the second leg portion of the corner mount secured to the inner surface of the side wall.

10 Claims, 1 Drawing Sheet

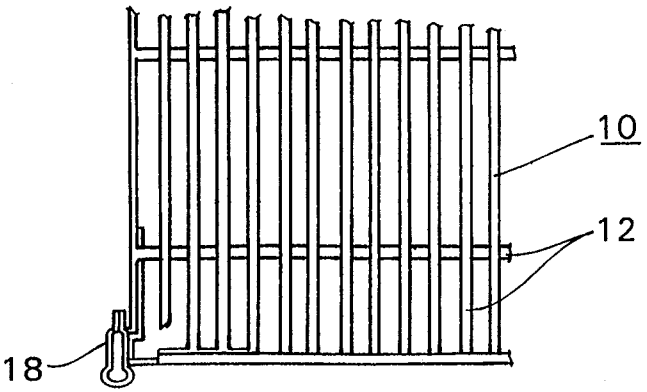
FIG. 1
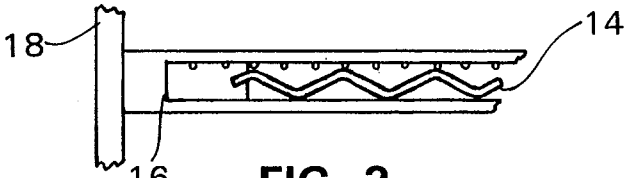
FIG. 2
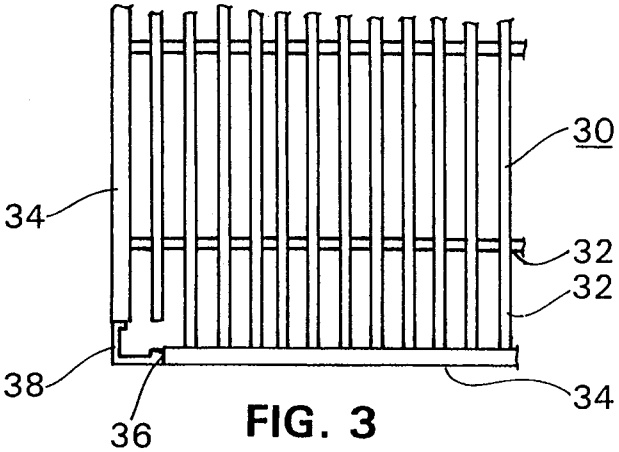
FIG. 3
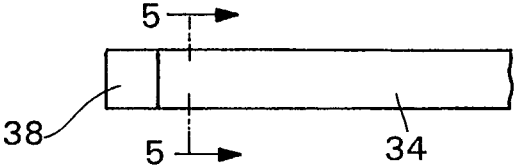
FIG. 4
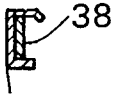
FIG. 5
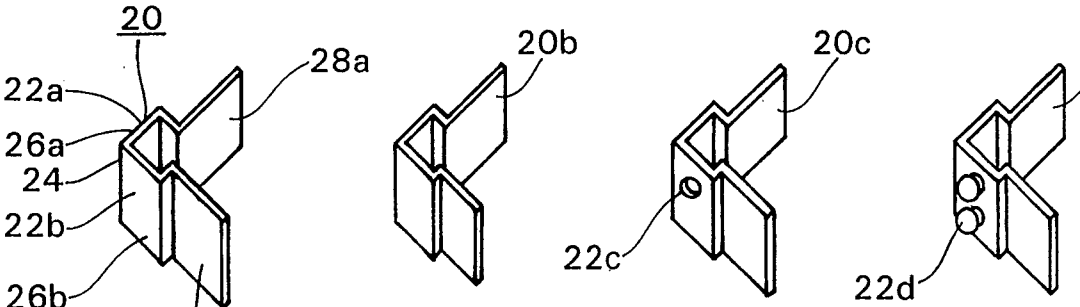
FIG. 6A
FIG. 6B
FIG. 6C
FIG. 6D

WIRE SHELF CORNER SUPPORT SYSTEM

FIELD OF THE INVENTION

The present invention relates to new and useful improvements in adjustable shelf systems permitting wire shelving to be used as a substitute for solid shelves in connection with most any conventional shelf support post system.

BACKGROUND OF THE INVENTION

Prior wire shelves either had to be surrounded with a continuous box frame to be used with standard support systems or required specially adapted shelf support posts which could not be used interchangeably with conventional solid shelf support systems. This is because the corner mounts for wire shelves were offset from the plane of the side of the shelf and thus the shelf wires would interfere with connecting the shelves to standard shelf support posts.

Wire shelves are desirable in shelving systems because of their greater strength, the ability to view objects on shelves at other than eye level and the fact that they allow free air movement around the stored objects. However, in many wire shelf support systems these benefits are overbalanced by increased costs due to the need for specially designed corner supports and posts.

In conventional wire shelf systems, if the user had to add or remove shelves, it was necessary to at least partially disassemble the shelving structure. With the present system shelves can be added, removed or relocated without modifying or disassembling the existing shelving unit.

With the foregoing in mind, a principal object of the present invention is to provide a novel wire shelf structure which may be manufactured economically and be used interchangeably with conventional solid shelf support systems and which permits removal or addition of individual shelves without requiring disassembly of the unit or adjustment of other shelves in the system.

Another object of the present invention is to provide a simple shelf corner mount that can be readily secured to wire shelving permitting the wire shelving to be used with most any conventional industrial shelf support post systems.

Other objects, features and characteristics of the present invention as well as the operation and use of the same will be apparent from the following description of the invention and the accompanying drawings.

SUMMARY OF THE PRESENT INVENTION

As set forth above, the primary object of this invention is to provide a novel wire shelf structure permitting wire shelves to be utilized with conventional shelf support systems. This is accomplished by providing a novel corner mount member that can be secured by welding or other means to the inner surface of the sides of the wire shelf at each corner thereof. The corner mount member is generally L-shaped with two leg portions extending at right angles to one another. Each leg has a proximal or inner end at the juncture of the legs extending to the terminal end of the side wall of the corner of the wire shelf to which the mount is secured. The legs then terminate in a distal end inwardly offset from the proximal end a distance equal to the thickness of the shelf side edge. This distal end extends along the inner surface of the shelf side wall in abutting relationship therewith and is secured to the side wall, for example by resistance or other type of welding. This construction provides a wire shelf structure in which the entire length of the outer surface of each side wall of the wire shelf, including the proximal end portions of the shelf mount members, from corner to corner, lies in a continuous flat plane with an L-shaped mounting surface at each corner suitable for attachment to any existing shelf support system.

BRIEF DESCRIPTION OF THE DRAWINGS

FIG. 1 is a plan view of a corner portion of one form of wire shelf utilizing the corner mount of the present invention;

FIG. 2 is a side view of the wire shelf of FIG. 1;

FIG. 3 is a view similar to FIG. 1 of a second form of wire shelf and corner mount;

FIG. 4 is a side view of the wire shelf of FIG. 3;

FIG. 5 is a sectional view taken along line 5—5 of FIG. 4; and,

FIGS. 6A, 6B, 6C, and 6D are perspective views of various forms of corner mounts of the present invention for use with existing forms of shelf support post systems.

DETAILED DESCRIPTION OF THE INVENTION

Referring more specifically to the drawings, in FIG. 1 there is illustrated a wire shelf 10 formed of a series of horizontal support wires 12 extending at right angles to one another and having a side wall portion 14 of an open wire construction. This is one form of a conventional open wire shelf with which the present invention may be used. As can be seen, each side wall 14 terminates short of the corner of the wire shelf as shown at 16.

In accordance with the present invention, the wire shelf 10 is adapted to be secured to a vertical post 18 of a shelf support system. The vertical post 18 can be of any standard form, having openings or clips to which the shelf 10 can be attached. The attachment means of the present invention comprises a shelf or corner mount member 20, for example, as shown in FIG. 6A, one of which is secured to each of the four corners of the wire shelf 10. The basic form of the shelf mount member 20 is shown in FIG. 6A and comprises two horizontal leg portions **22*a* and 22*b* extending at right angles to each other with an apex 24 at the corner of the wire shelf 10. Each leg portion 22*a* and 22*b* has a proximal end portion 26*a* and 26*b* joining at the corner of the shelf structure which extend from the corner to the end of the side wall portions of the wire shelf. At the point where the leg portions of the shelf mount member abut the ends of the side walls of the wire shelf, the leg portions are displaced inwardly a distance approximately equal to the thickness of the side wall 14 of the wire shelf and terminate in distal end portions 28*a* and 28*b* which inwardly overlie the inner surfaces of the side walls 14**. These distal end portions extend lengthwise for a sufficient distance to adequately support the wire shelf and are secured to the side walls of the wire shelf in any desired manner, for example by a spot weld or a resistance weld.

This above construction provides a completed wire shelf member in which the outer surface of the side walls of the completed shelf, including the external surface of the shelf mounts 20, lie in a vertically extending flat plane throughout their entire length from corner to corner of the wire shelf 10.

FIG. 3 illustrates another form of wire shelf construction 30 in which the horizontal wire members 32 are secured to continuous side frame members 34 having a C-shaped cross section. The side frame members 34 terminate short of the corners of the wire shelf 30, as shown at 36 and a shelf or corner mount member 38, similar in construction to that of the corner mount member 20, with proximal and inwardly displaced distal leg portions is secured to adjacent side frame members 34. This construction, similar to that of FIG. 1, also provides a wire shelf structure in which the outer surface of each side wall of the completed shelf, including the shelf mount members, lies in a continuous flat vertical plane.

Various exemplary forms of corner shelf mounts are disclosed in FIGS. 6A to 6D, each designed to be secured to a different form of shelf support post. One proximal leg of the shelf mount member 20 of FIG. 6A will fit into a generally rectangular recess on the support post or in a clip (not shown) attached to a shelf support post 18. The mount member 20*b* of FIG. 6B has a cross sectional shape having a vertical outer surface, with the inner surface thereof tapering uniformly inward from top to bottom. This allows one of its proximal leg portions to fit into a tapered recess in a clip attached to a shelf support post. With reference to FIG. 6C, the mount member 20*c* has openings 22*c* in each proximal leg portion adapted to receive a bolt or other fastener passing through a corresponding opening in a shelf support post to secure the shelf to the post. The mount member 20*d* shown in FIG. 6D has one or more vertically spaced pins 22*d* with enlarged heads on their proximal leg portions which can pass through key-hole shaped slots in the support posts to secure the shelves in position. In all of these described forms of corner mounts, the distal leg portions are recessed inwardly from the proximal leg portions a distance equal to the width side wall of the shelf to provide a planar outer surface on all sides of the shelf. This construction, as set forth previously, provides the completed shelf with a flat planar side wall which will not interfere with mounting the shelf to a conventional shelf support member.

While particular embodiments of the present invention have been illustrated and described herein, it is not intended to limit the invention to such a disclosure and changes and modifications may be incorporated and embodied therein within the scope of the following claims.

I claim:

1. A shelf structure of generally rectangular shape adapted to be secured to vertical support posts, said shelf structure comprising a horizontal upper article receiving surface formed of wire members arranged in a criss-cross pattern and side wall portions projecting downwardly at a right angle to the surface of the shelf;

said side wall portions having inner and outer surfaces and terminating short of the corners of the shelf;

a corner mount member at each corner of the shelf for attachment to the vertical support posts, each said corner mount member having a pair of horizontally extending legs at right angles to one another, said legs having a proximal end portion at the junction of the legs terminating adjacent the terminal ends of the side wall portions and a distal end portion, the distal end portion of each leg having its outer surface recessed inwardly from the outer surface of the shelf a distance equal to the thickness of each side wall; and means securing the corner mounts to said shelf with the outer surface of the distal leg portions in engagement with the inner surface of the side walls adjacent the ends of the side walls.

2. The shelf structure of claim 1 wherein each said side wall is an open wire construction.

3. The shelf structure of claim 1 wherein each side wall is a solid structure depending downwardly from the article receiving surface at the perimeter thereof.

4. The shelf structure of claim 1 wherein the wire members forming the article receiving surface terminate short of the corners of the shelf.

5. The shelf structure of claim 1 wherein the corner mount member is a strip of uniform thickness and has a height substantially equal to that of the shelf side wall.

6. The shelf structure of claim 1 wherein the corner mount member has an outer surface on the proximal leg portions thereof lying in a flat plane coextensive with the plane of the outer surface of the side wall of the shelf to which the said leg is secured.

7. The shelf structure of claim 6 wherein the inner surface of the leg portions of the corner mount member taper inwardly uniformly from top to bottom toward the outer surface thereof.

8. The shelf structure of claim 6 wherein the proximal leg portions of each corner mount member have an opening therein by means of which the corner mounts are secured to said corner support posts.

9. The shelf structure of claim 6 wherein the proximal leg portions of each corner mount member have pins with enlarged head portions thereon by means of which the corner mounts are secured to said corner support posts.

10. A corner mount member for a generally rectangular shelf structure adapted to be secured to vertical support posts, the shelf structure comprising a horizontal upper article receiving surface and side wall portions projecting downwardly at right angles to the surface of the shelf and terminating short of corners of the shelf;

said corner mount member comprising a pair of leg members extending parallel to the shelf side wall portions extending outwardly at right angles to one another from a corner junction of said corner mount member, each said leg having a proximal portion adjacent said corner and a distal portion remote from said corner, each said distal portion being displaced inwardly from its adjacent proximal portion a distance substantially equal to the thickness of the shelf side wall portions;

and means permanently securing said corner mount member to the shelf side wall portions.

* * * * *